United States Patent [19]

Herriott

[11] 4,316,339

[45] Feb. 23, 1982

[54] HANDGUN HAVING INTERCHANGEABLE BARRELS

[76] Inventor: Ray G. Herriott, 1671 S. Magnolia Ave., Monrovia, Calif. 91016

[21] Appl. No.: 87,058

[22] Filed: Oct. 22, 1979

[51] Int. Cl.[3] ..... F41C 1/00

[52] U.S. Cl. ..... 42/59; 42/75 B; 42/77

[58] Field of Search ..... 42/77, 59, 75 B, 75 C

[56] References Cited

U.S. PATENT DOCUMENTS

| | | | |
|---|---|---|---|
| 1,227,668 | 5/1917 | Reising | 42/75 C |
| 2,329,273 | 9/1943 | Kelly | 42/77 |
| 2,976,638 | 3/1961 | Owens | 42/77 |
| 3,280,495 | 10/1966 | Lewis | 42/77 |
| 4,109,403 | 8/1978 | Badali | 42/75 B |

*Primary Examiner*—Charles T. Jordan

*Attorney, Agent, or Firm*—Fraser and Bogucki

[57] ABSTRACT

A replaceable barrel which screws into a threaded aperture in the frame of a handgun in the form of a single action revolver is properly positioned with respect to the front sight thereon and rigidly secured to the frame by an arrangement which utilizes the base pin for the cylinder and which includes a lug formed on the outside of the barrel adjacent the frame. The cylinder base pin couples to the lug to provide the barrel with the proper angular position relative to the frame and to index the lug and included barrel relative to the frame to compensate for any play therebetween. In a first arrangement for securing the cylinder base pin to the lug a set screw having a threaded exterior is screwed into a threaded aperture in the lug so as to force a conical shaped end thereof within an aperture for the base pin in the frame while at the same time receiving a necked-down front end of the cylinder base pin within a hollow interior thereof. In a second embodiment, the cylinder base pin which is threaded at its outer end so as to screw into a threaded aperture for the pin in the frame terminates in a cylindrical element of larger diameter which seats against an annular flange within an aperture in the lug. The replaceable barrels which may be of different caliber extend into the cylinder window in the frame by varying distances which index with the varying caliber cylinders of different lengths to prevent use of a cylinder of given caliber with a replacement barrel of smaller caliber.

12 Claims, 5 Drawing Figures

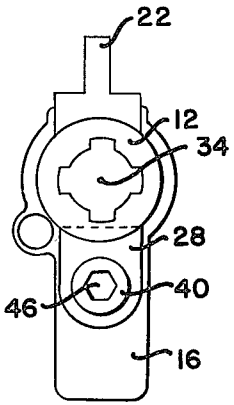
FIG.3
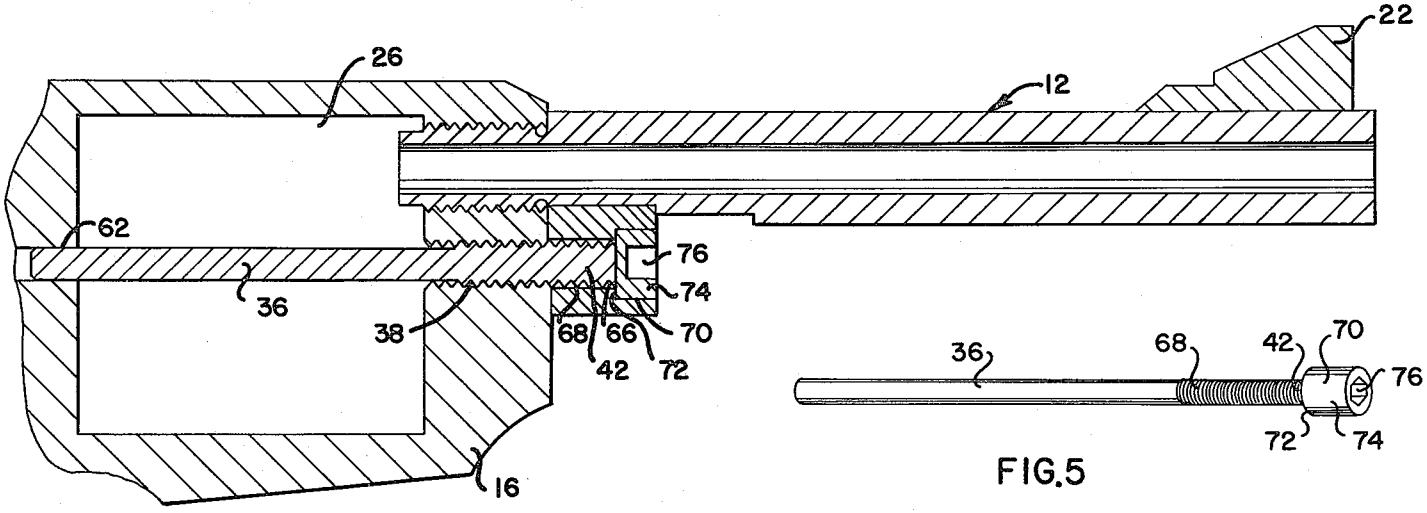
FIG.4
FIG.5

HANDGUN HAVING INTERCHANGEABLE BARRELS

BACKGROUND OF THE INVENTION

1. Field of the Invention

The present invention relates to handguns, and more particularly to handguns of the revolver type having interchangeable barrels.

2. History of the Prior Art

It is known to provide handguns with interchangeable barrels for various reasons such as the ability to replace a worn or defective barrel. Examples of guns having replaceable or removable barrels are provided by U.S. Pat. Nos. 2,238,587 of Gaidos, 4,109,403 of Badali, 2,747,313 of Crittendon et al, 3,150,458 of Browning, 1,373,888 of Johnson, 2,736,119 of Clarkson et al, 3,842,527 of Low and 3,464,136 of Wilhelm.

As shown by the above patents to Badali, Browning and Wilhelm, most handguns of the automatic type have removable barrels as part of the feature of such handguns that they are relatively easily disassembled for care and cleaning and parts replacement. As exemplified by the Badali patent the design of automatic type handguns is such that the barrel can be adequately secured to the frame of the gun simply by disposing the barrel in abutting relation with other parts of the gun frame and then securing the barrel in this position with screws or similar devices.

Revolvers, on the other hand, present a different type of handgun design which typically requires that the barrel be secured to the gun frame in a much more substantial manner than in the case of the automatic type handgun. As exemplified by the Gaidos patent the barrel of a revolver type of handgun is typically mounted by threading the rear portion of the barrel and screwing the threaded portion of the barrel into a threaded aperture in the gun frame until an extremely tight fit is achieved. A barrel vise and other special equipment is typically required to remove or replace such a barrel. In any event the replacement cannot be done easily or quickly or without the use of the special tools and in many cases the application of substantial force beyond the strength of many individuals. With barrels of the type that screw into the gun frame there is the further problem that it is often difficult or impossible to position the barrel so that the front sight at the outer end of the barrel is in a precise upright position. The tendency is to tighten the barrel to a reasonable extent, after which the barrel is further tightened or loosened slightly until the front sight is in the proper position. At that, however, precise sight positioning is difficult or impossible to achieve without special equipment which indicates when the sight is in the exact upright position. Conventional handguns of the revolver type suffer from the further disadvantage that while the barrel may be replaceable, typically there is no provision for use of barrels of different caliber in conjunction with other interchangeable parts to provide a handgun of variable caliber.

Accordingly, it is an object of the invention to provide a handgun having an interchangeable barrel which is relatively easily and quickly removed from and installed in the gun.

It is a further object of the invention to provide a handgun in which the barrel may be changed relatively easily and quickly without the need for special tools or substantial strength on the part of the person changing the barrel.

It is a further object of the invention to provide interchangeable barrels for a handgun which utilize existing parts of the handgun in the indexing and registration of the barrel upon installation and which require little or no modification of the handgun and do not substantially alter the appearance of the handgun.

It is a still further object of the invention to provide interchangeable handgun barrels which combine with other interchangeable parts of the handgun to provide the handgun with a multi-caliber capability and at the same time a safety feature to prevent the use of a given barrel with ammunition of larger caliber.

BRIEF DESCRIPTION OF THE INVENTION

These and other objects are accomplished in accordance with the invention by providing a handgun in the form of a single action revolver having a replaceable barrel with a threaded end that is screwed into a threaded aperture in the revolver frame. The barrel need only be tightened finger-tight to achieve a relatively low-tolerance, close fit between the barrel and the frame as well as approximate positioning of the front sight. Precise angular positioning of the barrel for proper registration of the front sight as well as indexing so as to avoid any unwanted play or backlash between the barrel and frame are accomplished by securing a lug which extends from a portion of the barrel adjacent the threaded end thereof to a desired location on the frame. This is accomplished in accordance with the invention by utilizing the base pin which extends through the frame and rotatably mounts the cylinder of the revolver. The cylinder base pin is secured to the lug using different arrangements which fit within an aperture in the lug.

In one preferred arrangement for coupling the lug to the cylinder base pin, a set screw having a hollow interior receiving a necked-down outer end of the cylinder base pin has the threaded outer surface thereof screwed into a threaded aperture in the lug to dispose the base pin within the aperture therefor in the frame, thereby providing proper alignment of the barrel and its included lug relative to the frame. At the same time, the set screw has a conical end which extends into and engages an aperture for the base pin in the frame, thereby forcing the lug outwardly relative to the frame so as to take up any slack or play between the barrel and frame. The position of the set screw within the lug aperture is adjusted by a hex wrench positioned within a mating aperture at the end of the set screw opposite the cylinder base pin.

In an alternative arrangement for coupling the cylinder base pin to the lug, the outer end of the base pin is threaded and is screwed into a threaded aperture in the frame for the base pin. The outer end of the base pin is coupled to the lug by a cylindrical element mounted on and having a larger diameter than the diameter of the end of the base pin. The cylindrical element engages an annular flange within a stepped down aperture in the lug to provide the proper angular position of the barrel relative to the frame while at the same time pulling the lug against the frame to take up any slack or play between the two.

In accordance with the invention the interchangeable barrels not only provide for the use of barrels of different lengths with a given revolver but also enable the caliber of the given revolver to be changed. Each barrel extends through the frame and into the cylinder window by a distance directly related to the caliber thereof. At the same time different replacement cylinders which have like diameters have a length which varies directly with the caliber thereof. At the same time that the cylinder base pin is removed from the frame to permit installation of a new barrel, a new cylinder having a caliber corresponding to that of the new barrel is installed when the base pin is reinserted into the frame to secure the barrel lug to the frame. A barrel and a cylinder of like caliber are dimensioned such that there is adequate clearance between the front end of the cylinder and the adjacent end of the barrel within the cylinder window. In the event a cylinder of caliber larger than that of the barrel is attempted to be installed, installation is prevented by the length of the barrel within the cylinder window which is too long to permit the cylinder to fit within the cylinder window.

BRIEF DESCRIPTION OF THE DRAWINGS

The foregoing and other objects, features and advantages of the invention will be apparent from the following more particular description of preferred embodiments of the invention, as illustrated in the accompanying drawings, in which:

FIG. 3 is a front view of the arrangement of FIG. 1;

FIG. 4 is a side sectional view similar to that of FIG. 2 but showing an alternative arrangement of a revolver having an interchangeable barrel in accordance with the invention; and FIG. 5 is a perspective view of a cylinder base pin with cylindrical element at the outer end thereof used in the arrangement of FIG. 4.

DETAILED DESCRIPTION

Figure 1:
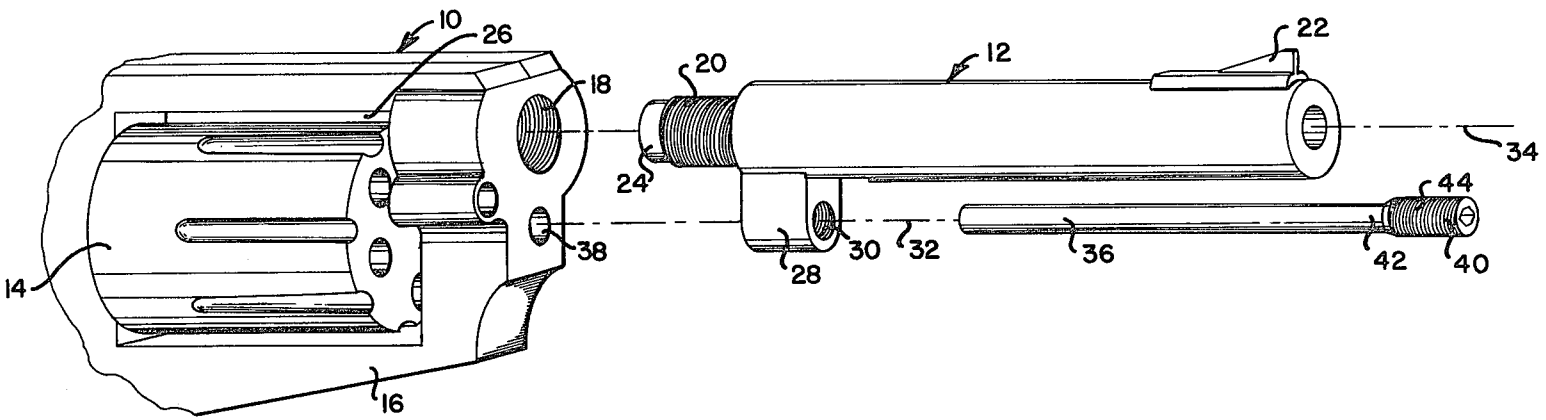
FIG. 1 is a perspective, exploded view of a portion of a revolver having an interchangeable barrel in accordance with the invention.

FIG. 1 depicts a handgun in the form of a revolver 10 having an interchangeable barrel 12 in accordance with the invention. The revolver 10 includes a cylinder 14 of conventional design and a cylinder frame 16 which is of conventional design except for certain possible modifications discussed hereafter. The remainder of the revolver 10 including the handle, the trigger and the hammer are also of conventional design and have been omitted for simplicity of explanation.

In the example of FIG. 1, the frame 16 has a threaded aperture 18 therein for receiving a threaded portion 20 of the barrel 12. Since most revolvers are provided with a screw-in barrel, the cylinder frame 16 may already have the threaded aperture 18. If not, the threaded aperture 18 is created in the frame 16 for receipt of the threaded portion 20 of the barrel 12.

The main portion of the barrel 12 is of conventional design and includes a front sight 22 mounted on the top thereof opposite the threaded portion 20. The threaded portion 20 terminates in an unthreaded collar 24 having a predetermined length such that it will extend into a cylinder window 26 within the frame 16 a selected distance as described hereafter.

The barrel 12 is provided with a lug 28 mounted at the underside thereof adjacent the threaded portion 20. The lug 28 may be formed as a part of the barrel 12 or may be formed as a separate element which is thereafter affixed to the barrel 12 such as by welding. The lug 28 has a threaded aperture 30 extending through the length thereof so as to have an axis of elongation 32 generally parallel to an axis of elongation 34 for the barrel 12 and the threaded aperture 18 in the cylinder frame 16.

Figure 2:
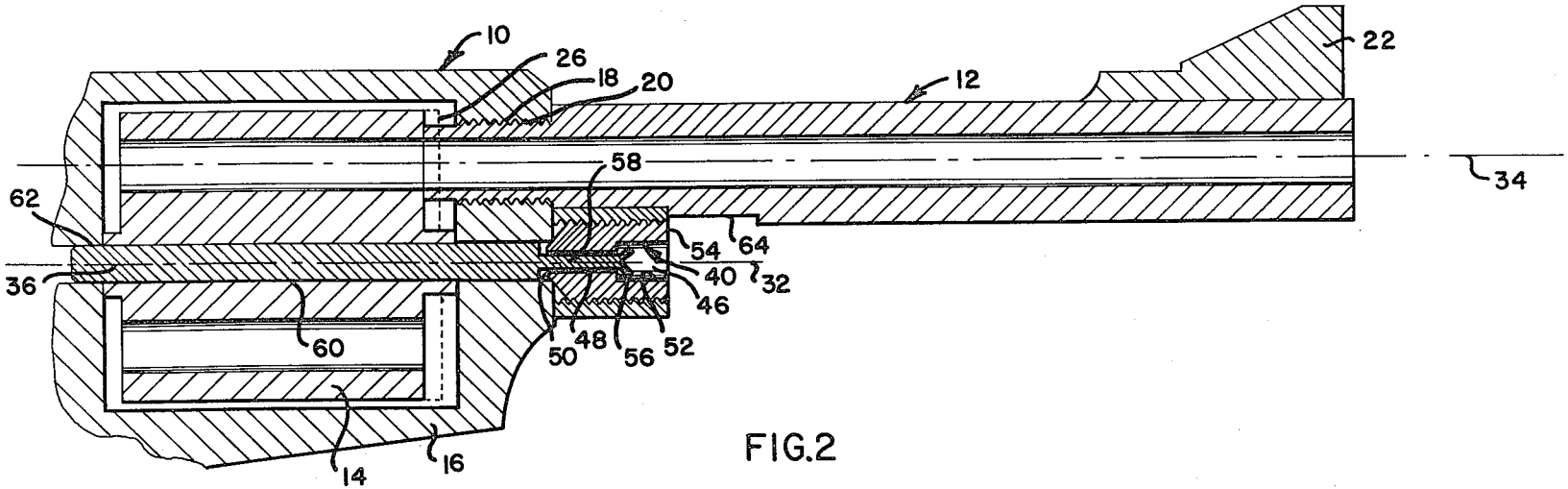
FIG. 2 is a sectional view of the arrangement of FIG. 1.

In the example of FIG. 1 the revolver 10 is of the single action type so as to utilize a cylinder base pin 36. The base pin 36 extends through an aperture 38 in the frame 16 to rotatably mount the cylinder 14. In accordance with the invention the base pin 36 is modified so as to have a set screw 40 mounted at an outer end 42 thereof. As the base pin 36 is inserted through the threaded aperture 30 in the lug 28 and into the aperture 38 in the frame 16 to mount the cylinder 14, the set screw 40 which has a threaded outer surface 44 of generally cylindrical configuration is screwed into the threaded aperture 30 in the lug 28 until the set screw 40 is properly seated within the lug 28. As shown in FIG. 2 the set screw 40 has a stepped-down aperture 46 through the length thereof and including a first generally cylindrical portion 48 extending into the set screw 40 from an end 50 of the screw 40 and a second generally hexagonal portion 52 extending into the set screw 40 from an opposite end 54 of the screw 40 and having transverse dimensions larger than the diameter of the first cylindrical portion 48. The intersection of the first and second portions 48 and 52 of the stepped-down aperture 46 defines an annular flange 56.

The base pin 36 has a necked-down portion 58 at the outer end 42 thereof. The generally cylindrical necked-down portion 58 has a diameter less than the diameter of the remainder of the base pin 36 and slightly less than the diameter of the first cylindrical portion 48 of the stepped-down aperture 46 within the set screw 40. The outer end of the necked-down portion 58 is flared outwardly so as to have a transverse size greater than the diameter of the first cylindrical portion 48 but less than the transverse dimensions of the second hexagonal portion 52 of the stepped-down aperture 46 in the set screw 40. This prevents removal of the set screw 40 from the base pin 36 while at the same time allowing rotation of the base pin 36 relative to the set screw 40 and providing a desired amount of play between the base pin 36 and the set screw 40.

Installation of the barrel 12 in the revolver 10 is accomplished by inserting the threaded portion 20 into the threaded aperture 18 in the frame 16. The barrel 12 is then rotated to screw the threaded portion 20 thereof into the frame until the barrel 12 is finger-tight within the frame 16 and the lug 28 resides against the frame 16. Minor changes in the angular position of the barrel 12 relative to the frame 16 are then made as necessary so as to align the threaded aperture 30 within the lug 28 with the aperture 38 in the frame 16. This simple act properly registers the barrel 12 relative to the frame 16 so that the front sight 22 is in the desired upright position. While holding the cylinder 14 in place within the cylinder aperture 26, the cylinder base pin 36 is inserted through the threaded aperture 30 in the lug 28 and through the aperture 38 in the frame 16. As shown in FIG. 2, the base pin 36 extends through a central aperture 60 in the cylinder 14 and into an aperture 62 at the rear of the cylinder frame 16 to properly mount the cylinder 14. As the base pin 36 is moved through the central aperture 60 in the cylinder 14 and into the aperture 62 at the rear of the frame 16, the set screw 40 enters the threaded aperture 30 within the lug 28. At this point the set screw 40 is screwed into the lug 28 with the aid of a hex wrench (not shown) inserted in the second hexagonal-shaped portion 52 of the stepped-down aperture 46 within the set screw 40. The bottom of the barrel 12 adjacent the lug 28 is ground flat at an area 64 to facilitate insertion of the set screw 40 into the lug 28 and to provide access of the hex wrench to the set screw 40.

When the set screw 40 has been screwed through a substantial portion of the length of the threaded aperture 30 in the lug 28, the end 50 of the set screw 40 which is tapered or generally conical in shape begins to engage the lips of the aperture 38 in the frame 16. Continued tightening of the set screw 40 forces the lug 28 outwardly relative to the frame 16 so as to take up any slack or unwanted play left by the finger-tight fitting of the barrel 12 to provide proper indexing of the barrel 12 to the frame 16. At the same time the lug 28 remains in the same angular position relative to the axis of elongation 34 of the barrel 12 and the threaded aperture 18 within the frame 16 so as to maintain the desired registration of the front sight 22 on the revolver 10.

In accordance with the invention the revolver 10 can be given a multi-caliber capability through use of different barrels 12 of different caliber in conjunction with different cylinders 14 of different caliber. The barrels 12 of different caliber are alike except for the caliber of the bore therein, the length of the collar 24 at the end of the threaded portion 20 which varies with the caliber of the barrel and the overall length of the barrel. The various cylinders 14 of different caliber have the same diameter and vary only in the length thereof and the size of the chambers therein. The length of the cylinder 14 increases with increasing caliber of the bullets held by the cylinder 14. Conversely the collar 24 of the barrel 12 decreases in length with increasing caliber of the barrel. Thus, as the length of the cylinder 14 increases for larger calibers, the collar 24 of the barrel 12 decreases with barrels of the larger calibers to permit the required small amount of clearance between the front end of the cylinder 14 and the collar 24. In the event a cylinder 14 of caliber larger than that of the barrel 12 is attempted to be installed in the revolver 10, thereby posing a safety problem, installation of the cylinder 14 is prevented by the length of the collar 24 of the barrel 12 which does not allow enough clearance to properly seat the cylinder 14 within the cylinder window 26.

Removal of the barrel 12 from the revolver 10 is accomplished by applying the hex wrench or other appropriate tool to screw the set screw 40 out of the threaded aperture 30 in the lug 28. With the set screw 40 unscrewed from the lug 28, the base pin 36 can be pulled out of the frame 16 and the cylinder 14 can be removed. Since the barrel 12 was only tightened finger-tight when installed, it is easily unscrewed by hand from the threaded aperture 18 in the frame 16.

The embodiment shown in FIGS. 1–3 requires no modification to a conventional revolver 10 which has a threaded aperture 18 for receiving the barrel. FIGS. 4–5 depict an alternative embodiment which requires a slight modification to the cylinder frame 16. The embodiment of FIGS. 4–5 utilizes the interchangeable barrel 12 shown in FIGS. 1–3. However, instead of having the threaded aperture 30, the lug 28 has an unthreaded stepped-down aperture 66 consisting of a generally cylindrical first portion 68 and a generally cylindrical second portion 70 of larger diameter than and forming an annular collar or flange 72 at the intersection thereof with the first cylindrical portion 68. The barrel 12 is screwed into the cylinder frame 16 finger-tight in the same manner described in connection with FIGS. 1–3.

The cylinder frame 16 is modified to the extent that the aperture 38 within the frame 16 for receiving the cylinder base pin 36 is threaded. The outer end 42 of the base pin 36 which terminates in a generally cylindrical element 74 is also threaded along a portion of the length thereof so as to screw into and engage the threads of the aperture 38 when the base pin 36 is inserted through the aperture 66 in the lug 28 and through the aperture 38 in the cylinder frame 16. The cylindrical element 74 has an outer diameter larger than the diameter of the first portion 68 of the aperture 66 and slightly smaller than the second portion 70 of the aperture 66 so as to reside against the annular collar or flange 72. The element 74 has a hexagonal recess 76 therein which is adapted to receive a hex wrench (not shown).

Upon finger-tight installation of the barrel 12 in the manner described in connection with FIGS. 1–3, the cylinder base pin 36 having the cylindrical element 74 coupled to the outer end 42 thereof is inserted through the aperture 66 in the lug 28 and through the aperture 38 in the cylinder frame 16. As the base pin 36 moves through the cylinder chamber 26 toward the aperture 62 the threads at the outer end 42 of the base pin 36 encounter the threads of the aperture 38 in the frame 16. At this point the element 74 is rotated by hand or using a hex wrench so as to screw the outer end 42 of the cylinder pin 36 into the threaded aperture 38. As the opposite end of the cylinder base pin 36 enters the aperture 62 within the cylinder frame 16 and the element 70 encounters the flange 72 it is usually necessary to use a hex wrench to tighten the base pin 36 into place.

Whereas the embodiment of FIGS. 1–3 utilizes the set screw 40 with its conical end 50 to force the lug 28 outwardly and away from the cylinder frame 16 so as to take up any play or slack between the barrel 12 and the cylinder frame 16, the embodiment of FIGS. 4–5 clamps the lug 28 against the outside surface of the cylinder frame 16 to provide proper indexing of the barrel 12 relative to the frame 16. At the same time, alignment of the aperture 66 within the lug 28 with the aperture 38 in the frame 16 and use of the cylinder base pin 36 assures proper registration of the barrel 12 and its included front sight 22. The cylinder 14 which is omitted from FIG. 4 for simplicity of illustration engages the collar 24 of the installed barrel 12 to prevent installation of the cylinder in the event the caliber of the cylinder is greater than that of the barrel 12.

Removal of the barrel 12 in the arrangement of FIGS. 4–5 is accomplished by insertion of a hex wrench into the recess 76 within the cylindrical element 74. When the cylinder base pin 36 has been unscrewed and removed, the cylinder can be removed as well as the barrel 12. The barrel 12 which was only tightened finger-tight during installation is readily removed by hand by unscrewing from the cylinder frame 16.

Revolvers constructed and successfully tested in accordance with the invention have provided as many as five different calibers in a single revolver simply by interchanging the barrel and cylinder. The five different calibers of a single revolver have included 9 millimeter, 357 magnum, 41 magnum, 44 magnum and 45 caliber. The collar from the threaded end of the barrel extending into the cylinder window varied in length over a range of 0.0020 inch for the five different barrels used, to provide the safety feature described above.

While the invention has been particularly shown and described with reference to preferred embodiments thereof, it will be understood by those skilled in the art that the foregoing and other changes in form and details may be made therein without departing from the spirit and scope of the invention.

I claim:

1. A revolver comprising the combination of a frame having a threaded bore therein, a barrel having a threaded end received within the threaded bore of the frame, a lug mounted on the barrel adjacent the threaded end and means fastening the lug to a selected portion of the frame to provide indexing and registration of the barrel relative to the frame.

2. The invention set forth in claim 1, wherein the revolver has a cylinder mounted within the frame, the lug has an aperture therein and the means fastening the lug includes a base pin extending through a portion of the frame and through the cylinder and an element coupled to an end of the base pin and secured within the aperture in the lug.

3. The invention set forth in claim 2, wherein the aperture in the lug has a threaded interior and said element comprises a generally cylindrical member rotatably secured to said end of the base pin and having a threaded outer surface engaged with the threaded interior of the aperture in the lug and a tapered end engaging a portion of the frame.

4. The invention set forth in claim 2, wherein said end of the base pin is threaded and is received within a threaded aperture in the frame, the aperture in the lug has an annular collar therein defined by the interface between a portion of smaller diameter and a portion of larger diameter and the element comprises a generally cylindrical member coupled to said end of the base pin and having an outer diameter larger than the smaller diameter of the aperture in the lug so as to reside against the collar.

5. A revolver comprising the combination of a frame, a cylinder base pin mounted within the frame and extending through a frame aperture in a forward portion of the frame and a barrel removably mounted on the frame at the forward portion of the frame and having a barrel aperture therein generally continuous with the frame aperture, the cylinder base pin extending into the barrel aperture and securing the barrel to the frame in a predetermined position.

6. The invention set forth in claim 5, wherein the barrel is rotatable relative to the frame and includes a lug extending outwardly from the barrel adjacent the frame and having the barrel aperture therein and further including a member coupled to the cylinder base pin and secured within the barrel aperture.

7. A revolver comprising the combination of a frame, a cylinder base pin mounted within the frame, a barrel removably mounted on the frame and means coupling the barrel to the cylinder base pin to secure the barrel to the frame in a predetermined position, the means coupling the barrel to the cylinder base pin including a lug extending outwardly from the barrel adjacent the frame and having an aperture therein and a member coupled to the cylinder base pin and secured within the aperture in the lug, the aperture in the lug being threaded, the cylinder base pin having an outer end of reduced diameter terminating in a tip of larger diameter and the member having a threaded cylindrical outer surface threaded to the threaded aperture in the lug, a generally cylindrical inner bore receiving the outer end of the cylinder base pin and a generally conically shaped end engaging the frame.

8. A revolver comprising the combination of a frame, a cylinder base pin mounted within the frame, a barrel removably mounted on the frame and means coupling the barrel to the cylinder base pin to secure the barrel to the frame in a predetermined position, the means coupling the barrel to the cylinder base pin including a lug extending outwardly from the barrel adjacent the frame and having an aperture therein and a member coupled to the cylinder base pin and secured within the aperture in the lug, the aperture in the lug having an annular flange therein, the cylinder base pin having a threaded end which is threaded to a threaded aperture within the frame, and the member comprising a generally cylindrical element coupled to the outer end of the cylinder base pin and engaging the annular flange within the aperture in the lug.

9. A replaceable barrel assembly for use with a revolver comprising the combination of a generally cylindrical barrel having a threaded end adapted to screw into a revolver frame, a lug formed on an outer surface of the barrel adjacent the threaded end, a cylinder base pin adapted to rotatably support a cylinder within a revolver frame, and means for selectively coupling the cylinder base pin to the lug.

10. The invention set forth in claim 9, wherein the lug has an aperture therein and the means for selectively coupling includes a member mounted on an end of the cylinder base pin and adapted to be secured within the aperture in the lug.

11. The invention set forth in claim 10, wherein the aperture in the lug is threaded, the cylinder base pin has an outer end of reduced diameter terminating in a tip of larger diameter and the member has a threaded cylindrical outer surface adapted to be threaded to the threaded aperture in the lug, an aperture therein having a first generally cylindrical portion surrounding the outer end of the cylinder base pin and a second generally hexagonal portion of larger diameter than the first generally cylindrical portion surrounding the tip of the cylinder base pin and an end of generally conical shape extending from the first generally cylindrical portion of the aperture therein.

12. The invention set forth in claim 10, wherein the aperture in the lug has a first generally cylindrical portion adjacent the threaded end of the barrel and a second generally cylindrical portion opposite the threaded end of the barrel, the second generally cylindrical portion being of larger diameter than and forming an annular flange with the first generally cylindrical portion, the cylinder base pin has a threaded outer end and the member comprises a generally cylindrical element mounted on the outer end of the cylinder base pin and having a diameter greater than the diameter of the first generally cylindrical portion but less than the diameter of the second generally cylindrical portion of the aperture in the lug.

* * * * *